US007454821B2

(12) United States Patent
Cooper et al.

(10) Patent No.: US 7,454,821 B2
(45) Date of Patent: Nov. 25, 2008

(54) WALL SCRUBBER FOR BLOWN INSULATION

(75) Inventors: Mary Elizabeth Cooper, Fort Mill, SC (US); Patrick Ambrose Dwyer, Weddington, NC (US)

(73) Assignee: US GreenFiber, LLC, Charlotte, NC (US)

( * ) Notice: Subject to any disclaimer, the term of this patent is extended or adjusted under 35 U.S.C. 154(b) by 170 days.

(21) Appl. No.: 10/964,545

(22) Filed: Oct. 13, 2004
(Under 37 CFR 1.47)

(65) Prior Publication Data

US 2006/0079158 A1 Apr. 13, 2006

(51) Int. Cl.
*B23P 23/00* (2006.01)
*A46B 13/02* (2006.01)

(52) U.S. Cl. ..... 29/33 R; 29/33 A; 15/344; 15/179; 15/182; 15/200

(58) Field of Classification Search ..... 409/295, 409/137; 30/475; 144/117.1, 252.1; 15/344, 15/179, 182, 197, 200; 29/33 R, 33 A, 33 K
See application file for complete search history.

(56) References Cited

U.S. PATENT DOCUMENTS 2,127,851 A * 8/1938 Wadhams ..... 451/352
2,264,278 A * 12/1941 Danforth ..... 409/178
2,324,272 A * 7/1943 Anderson ..... 15/179
2,680,938 A * 6/1954 Peterson ..... 451/67
2,740,148 A * 4/1956 Nelson et al. ..... 15/181
2,862,224 A * 12/1958 Swanson et al. ..... 15/328
2,997,730 A * 8/1961 Dierks ..... 15/368
4,050,112 A * 9/1977 Saxon ..... 15/422.2
4,601,104 A * 7/1986 Zaiser et al. ..... 30/475
5,251,355 A * 10/1993 Drumm ..... 15/182
5,297,363 A * 3/1994 Schroder et al. ..... 451/358
5,365,634 A * 11/1994 Hughes ..... 15/366
5,383,275 A * 1/1995 Hild et al. ..... 409/137

(Continued)

FOREIGN PATENT DOCUMENTS

JP 01-103258 A * 4/1989

OTHER PUBLICATIONS

Krendl Wall Cavity Spray-On System, from Internet, www.krendlmachine.com/wallcavitysystems.html, 1998.

(Continued)

*Primary Examiner*—Erica E Cadugan
(74) *Attorney, Agent, or Firm*—MacCord Mason PLLC

(57) ABSTRACT

An insulation system comprising: a supply of material having discrete elements; an applicator assembly for installation of the material having discrete elements to a surface; and a scrubber for finishing the face of the material. In one embodiment, the scrubber includes: a vacuum conduit; a planer assembly attached to the vacuum conduit; a drive for the planer assembly; and a vacuum adjacent to the planer assembly for removing loose material created during finishing. Also, in the preferred embodiment, the insulation system further includes a transporter system downstream of the supply of material having discrete elements for delivery of the material to the applicator assembly.

6 Claims, 6 Drawing Sheets

U.S. PATENT DOCUMENTS

| | | | | |
|---|---|---|---|---|
| 5,403,128 | A * | 4/1995 | Thomas | 406/39 |
| 5,829,145 | A * | 11/1998 | Hughes | 30/475 |
| 6,354,009 | B1 * | 3/2002 | Belleau | 30/475 |
| 6,688,349 | B2 * | 2/2004 | Razlan et al. | 144/154.5 |
| 7,300,521 | B2 * | 11/2007 | Bowman et al. | 118/308 |
| 2003/0168122 | A1 * | 9/2003 | Razlan et al. | 144/154.5 |
| 2005/0188484 | A1 * | 9/2005 | Lytle | 15/52.1 |
| 2008/0081752 | A1 * | 4/2008 | Fellinger | 492/28 |

OTHER PUBLICATIONS

Krendl Machine Co., Inc., Model#349B, Wall Scrubber Parallel Handle, Jul. 1996.

* cited by examiner

V = (radius angular velocity)

= rω

= (1 in.) (2500 RPM)(60 sec/1 min)

V = 41.66 in/sec

Approx. Test Speed:

Vcrit ≈ 20 in/s

WALL SCRUBBER FOR BLOWN INSULATION

BACKGROUND OF THE INVENTION (1) Field of the Invention

The present invention relates generally to insulation systems, and, more particularly, to a scrubber for finishing the face of material having discrete elements.

(2) Description of the Prior Art

Insulation is used in residential and commercial dwellings both to conserve energy and to reduce noise. The two most common types of insulation are blown and batt. Blown insulation may be made from several lightweight natural or man-made materials. With the use of adhesives to bond the material, blown loose fill insulation may now be used on many different surfaces, including cavities formed between wall studs. When the blown insulation is installed in such a cavity, the surface of the insulation often needs to be finished in order to eliminate the protruding insulation before the drywall is installed. The wall studs may also need to be cleaned for this same purpose.

One current method used for completing this task includes scrubbing off the excess insulation from the surface with the use of a scrubber or planer, causing the excess material to fall to the floor to be swept or vacuumed up at a later time. This process has several disadvantages. First, the process is inefficient in that it demands two steps: removing the excess material and cleaning up the material at a later time. Another inconvenience of the current process is that the use of reclaim material can cause variations in finished wall moisture content and handling characteristics. Furthermore, the material may also have accumulated undesirable particulates and such from lying on the floor.

Thus, there remains a need for a new and improved process of finishing and removing the surface of blown insulation that can be done in a single step and can reclaim material that may be ready for reinstallation.

SUMMARY OF THE INVENTION

The present invention is directed to an insulation system comprising: a supply of material having discrete elements; an applicator assembly for installation of the material having discrete elements to a surface; and a scrubber for finishing the face of the material. In one embodiment, the scrubber includes: a vacuum conduit; a planer assembly attached to the vacuum conduit; a drive for the planer assembly; and a vacuum adjacent to the planer assembly for removing loose material created during finishing. Also, in the preferred embodiment, the insulation system further includes a transporter system downstream of the supply of material having discrete elements for delivery of the material to the applicator assembly.

In the preferred embodiment, the supply of material having discrete elements is selected from the group consisting of fibrous material, granular material, pellet material, agglomerated material, aggregated material and mixtures thereof.

The supply of material having discrete elements may be inorganic. Preferably, the inorganic material is selected from the group consisting of fiberglass, rock wool, pearlite, mineral wool, asbestos, and mixtures thereof.

The supply of material having discrete elements may be organic. Preferably, the organic material is a natural material such as cellulose.

In the preferred embodiment, the supply of material having discrete elements is a non-conductive material. The supply of non-conductive material may be a thermally non-conductive material or an acoustically non-conductive material or an electrically non-conductive material or mixtures thereof. The supply of material may further comprise material that has been reclaimed and recycled through the insulation system.

The applicator assembly may include: a nozzle having an inlet for receiving the material and an outlet for applying the material to a surface; and an adhesive applicator adjacent to the nozzle for activating a substantially water-free adhesive to provide structure to the material having discrete elements during installation.

Preferably, the adhesive applicator may include a supply of adhesive material and a spray head for supplying adhesive to the material having discrete elements. The supply of adhesive material may also include a hot melt adhesive and a heater assembly. The hot melt adhesive may be a thermoplastic adhesive.

In the preferred embodiment the vacuum conduit may include at least one inlet and at least one outlet. The open area of the inlet may be greater than the open area of the outlet.

Further, the apparatus may include a collector attached to the vacuum conduit adjacent to the planer assembly and the vacuum. The apparatus may further include a deflector attached to the vacuum conduit on the opposite side of the planer assembly from the collector and a transition zone between the inlet and the outlet.

In the preferred embodiment, the planer assembly is a rotary planer, wherein the axis of rotation of the rotary planer may be substantially parallel to the face of the material. The axis of rotation of the rotary planer may also be substantially perpendicular to the force of gravity. The direction of rotation of the rotary planer may be upward against the force of gravity when contacting a surface of a material to be finished, or the direction of rotation of the rotary planer may be downward against the force of gravity when contacting a surface of a material to be finished.

Preferably, the planer assembly may be a plurality of discrete planing elements. The planing surface of the planer may be a brush roller. Further, the brush roller may be a coil brush roller or a chevron brush roller.

In the preferred embodiment, the drive is an external drive. The drive may be belt drive or a timing belt drive.

Further, the apparatus may include a positioner attached to the vacuum conduit for moving the apparatus with respect to the face of the material. The positioner may include at least one handle.

Preferably, the vacuum may include a vacuum source attached to the vacuum for removing loose material created during finishing.

Further, the planer assembly may also include a planer having a planing surface such that the planing surface (for example the contact surface of a brush roller) rotates around the axis of rotation of the brush roller at a speed with respect to the material of between about 10 in/sec and about 300 in/sec. More specifically, the rotation speed of the contact surface with respect to the material may be about 40 in/sec.

Also in the preferred embodiment, the scrubber may be operable to finish the face of a material having discrete elements such that the material has a reclaim radius of between about 10 microns and 10,000 microns at 20% contact. The material reclaim radius may be about 1000 microns at 20% contact.

Preferably, the planer assembly includes a planer having a brush with a contact end, such that the contact end is between about ¼ inches and about 3 inches from the planer. The contact end may be about 1 inch from the planer.

In the preferred embodiment, the transporter system may include a conduit with an inlet and outlet; and an air supply to move the material having discrete elements through the conduit. The transporter system may further include a debailer for debailing bundles of the material having discrete elements.

Accordingly, one aspect of the present invention is to provide an insulation system comprising: a supply of material having discrete elements; an applicator assembly for installation of the material having discrete elements to a surface; and a scrubber for finishing the face of the material, the scrubber including a vacuum for removing loose material created during finishing.

Another aspect of the present invention is to provide a scrubber for finishing the face of a material having discrete elements, the apparatus comprising: a vacuum conduit; a planer assembly attached to the vacuum conduit; a drive for the planer assembly; and a vacuum adjacent to the planer assembly for removing loose material created during finishing.

Still another aspect of the present invention is to provide an insulation system comprising: a supply of material having discrete elements; an applicator assembly for installation of the material having discrete elements to a surface; a transporter system downstream of the supply of material having discrete elements for delivery of the material to the applicator assembly; and a scrubber for finishing the face of the material. The scrubber includes: a vacuum conduit; a planer assembly attached to the vacuum conduit; a drive for the planer assembly; and a vacuum adjacent to the planer assembly for removing loose material created during finishing.

These and other aspects of the present invention will become apparent to those skilled in the art after a reading of the following description of the preferred embodiment when considered with the drawings.

DESCRIPTION OF THE PREFERRED EMBODIMENTS

Figure 1:
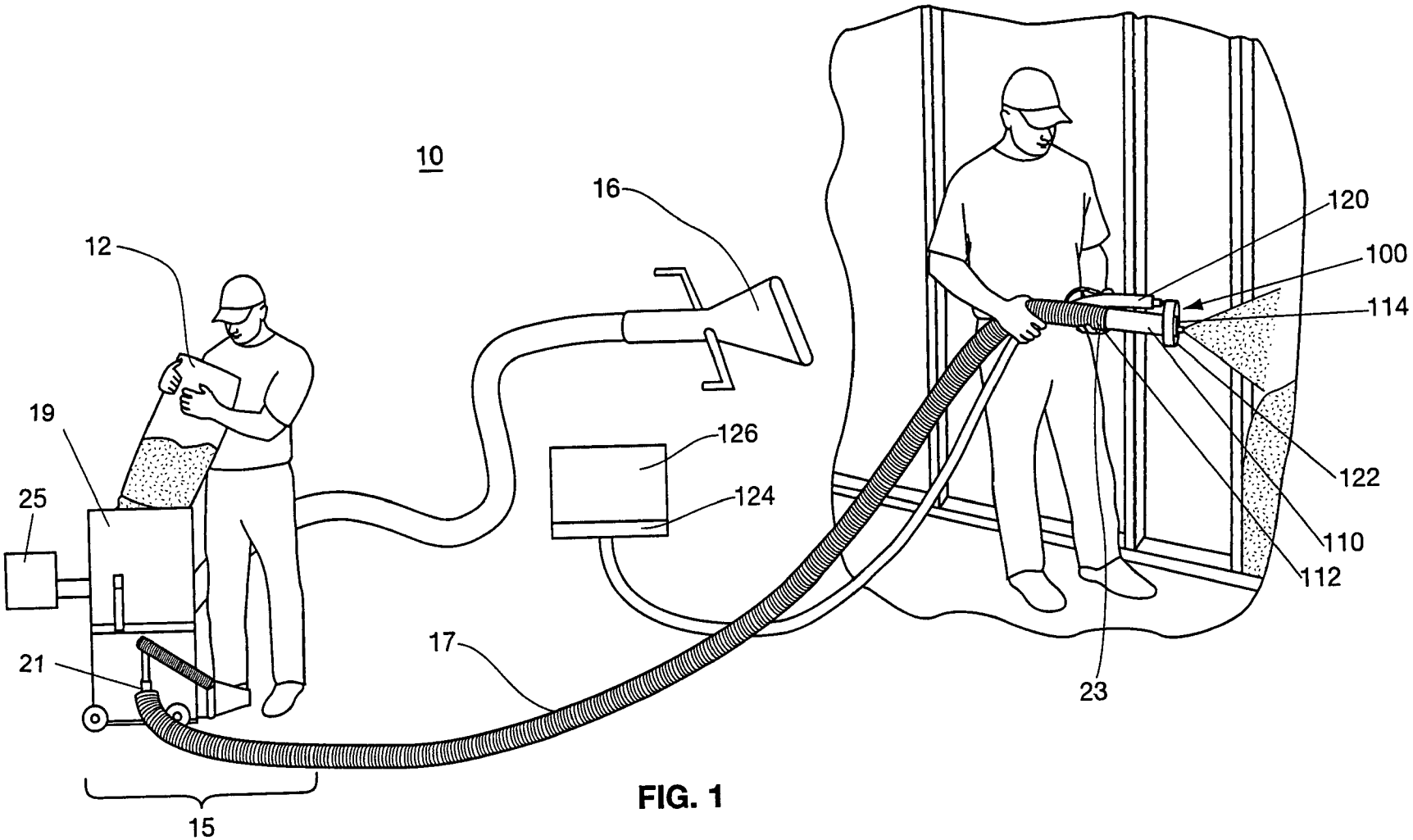
FIG. 1 is an insulation system constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto.

As best seen in FIG. 1, an insulation system, generally designated 10, is shown constructed according to the present invention. The insulation system 10 may comprise: a supply of material 12 having discrete elements; an applicator assembly 100 for installation of the material 12 having discrete elements to a surface; and a scrubber 16 for finishing the face of the material 12, the scrubber 16 including a vacuum 24 for removing loose material created during finishing.

The system may further include a transporter system 15 downstream of the supply of material 12 having discrete elements for delivery of the material 12 to the applicator assembly 100. The transporter system 15 may include a conduit 17 with an inlet 21 and outlet 23; and an air supply 25 to move the material 12 having discrete elements through the conduit 17. The transporter system 15 may further include a debailer 19 for debailing bundles of the material 12 having discrete elements.

The supply of material 12 having discrete elements for the insulation system 10 the may be selected from the group consisting of fibrous material, granular material, pellet material, agglomerated material, aggregated material and mixtures thereof. The supply of material 12 having discrete elements may be inorganic. The inorganic material may be selected from the group consisting of fiberglass, rock wool, pearlite, mineral wool, asbestos, and mixtures thereof. The supply of material 12 having discrete elements may be organic. The organic material may be a natural material. The natural material may be cellulosic. The supply of material 12 having discrete elements may be a non-conductive material. The supply of non-conductive material may be a thermally non-conductive material. The supply of non-conductive material may be an acoustically non-conductive material. The supply of non-conductive material may be an electrically non-conductive material.

The applicator assembly 100 for the insulation system 10 may include: a nozzle 110 having an inlet 112 for receiving the material 12 and an outlet 114 for applying the material 12 to a surface; and an adhesive applicator 120 adjacent to the nozzle 110 for activating a substantially water-free adhesive 126 to provide structure to the material 12 having discrete elements during installation. The adhesive applicator 120 may include a supply of adhesive material 126 and a spray head 122 for supplying adhesive 126 to the material 12 having discrete elements. The supply of adhesive 126 material may include a hot melt adhesive and a heater assembly 124. The hot melt adhesive may be a thermoplastic adhesive.

Figure 2:
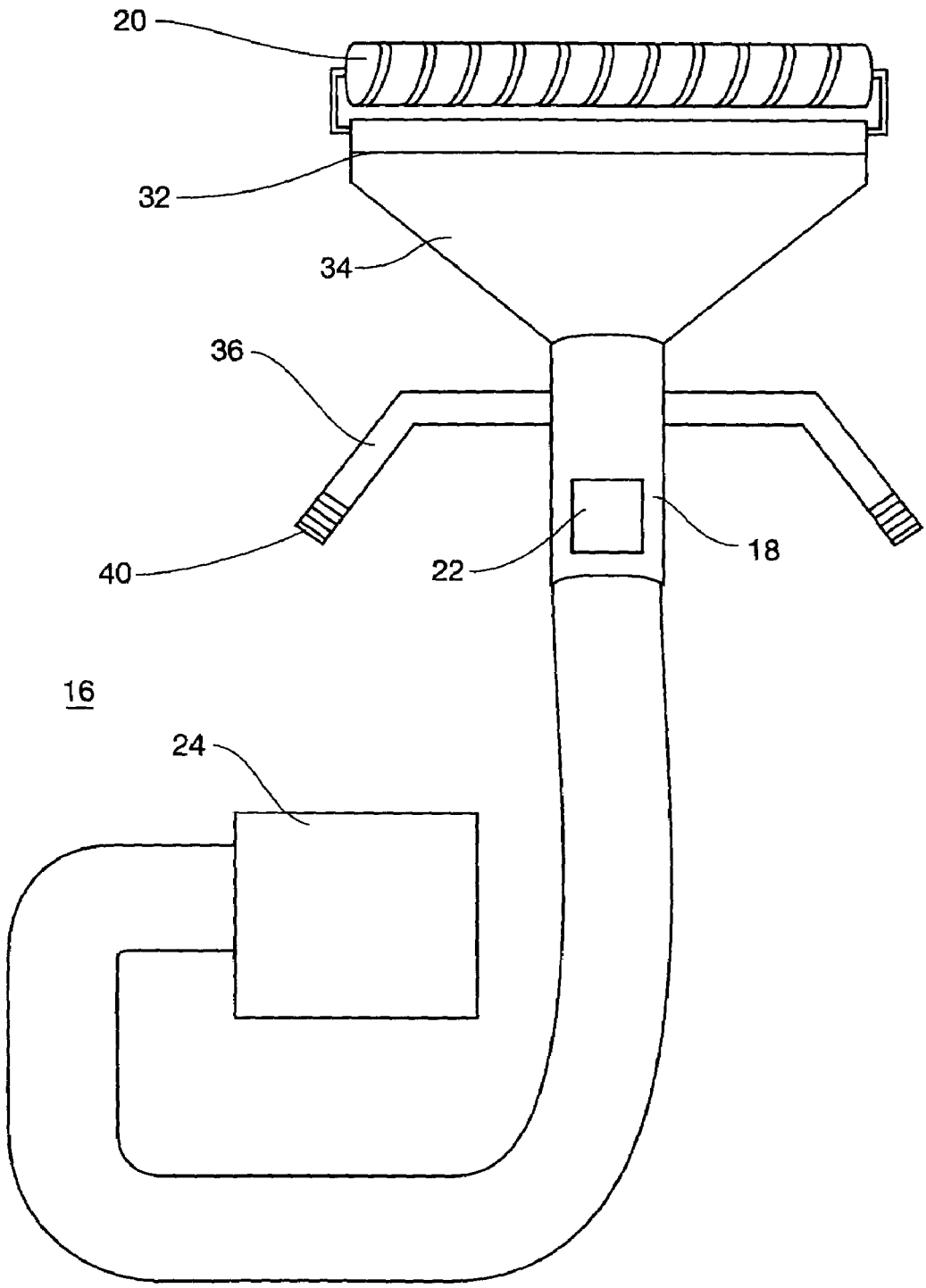
FIG. 2 is a top view of a scrubber for finishing the face of a material having discrete elements.

FIG. 2 shows a scrubber 16 for finishing the face of a material 12 having discrete elements comprising: a vacuum conduit 18; a planer assembly 20 attached to the vacuum conduit 18; a drive 22 for the planer assembly 20; and a vacuum 24 adjacent to the planer assembly 20 for removing loose material created during finishing.

The planer assembly 20 may include a rotary planer. The axis of rotation of the rotary planer may be substantially parallel to the face of the material. The axis of rotation of the rotary planer may be substantially perpendicular to the force of gravity. The direction of rotation of the rotary planer may be upward against the force of gravity. The direction of rotation of the rotary planer may be downward against the force of gravity. The planer assembly 20 may comprise a plurality of discrete planing elements.

The planing surface of the planer in the planing assembly 20 may be a brush roller. The planing surface of the brush roller may be a coil brush roller. The planing surface of the brush roller may be a chevron brush roller. The drive 22 included in the system may be an external drive. The drive 22 may be a belt drive. The drive 22 may further be a timing belt drive. The positioner 36 included in the system may be attached to the vacuum conduit 18 for moving the apparatus with respect to the face of the material. The positioner 36 may include at least one handle 40. The vacuum 24 included in the system may include a vacuum source attached to the vacuum 24 for removing loose material created during finishing.

Figure 3:
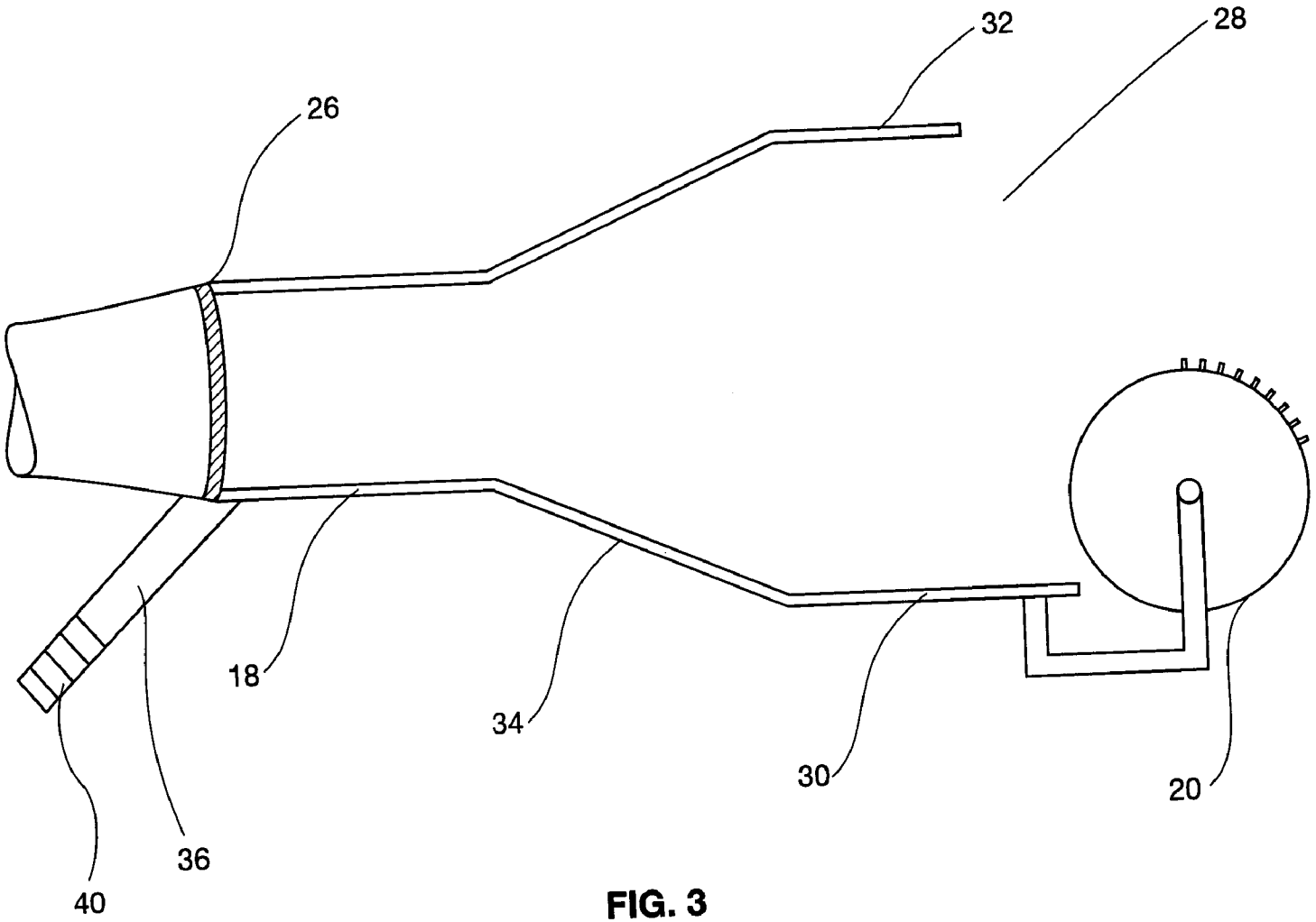
FIG. 3 is a side cross-section view of a scrubber for finishing the face of a material having discrete elements.

FIG. 3 is a side cross-section view of the scrubber for finishing the face of a material 12 having discrete elements. The vacuum conduit 18 may include an inlet 28 and an outlet 26. The conduit 18 may serve as a central conduit connected to more than one inlet 28, and likewise may include more than one outlet 26, and thus divide and direct the vacuum into separate streams to more effectively pull off insulation in certain zones. The open area of an inlet 28 may be greater than the open area of an outlet 26. The scrubber 16 may further include a collector 30 attached to the vacuum conduit 18 adjacent to the planer assembly 20 and the vacuum 24. The scrubber 16 may further include a deflector 32 attached to the vacuum conduit 18 on the opposite side of the planer assembly 20 from the collector 30. The scrubber 16 may further include a transition zone 34 between the inlet 28 and the outlet 26.

Figure 4:
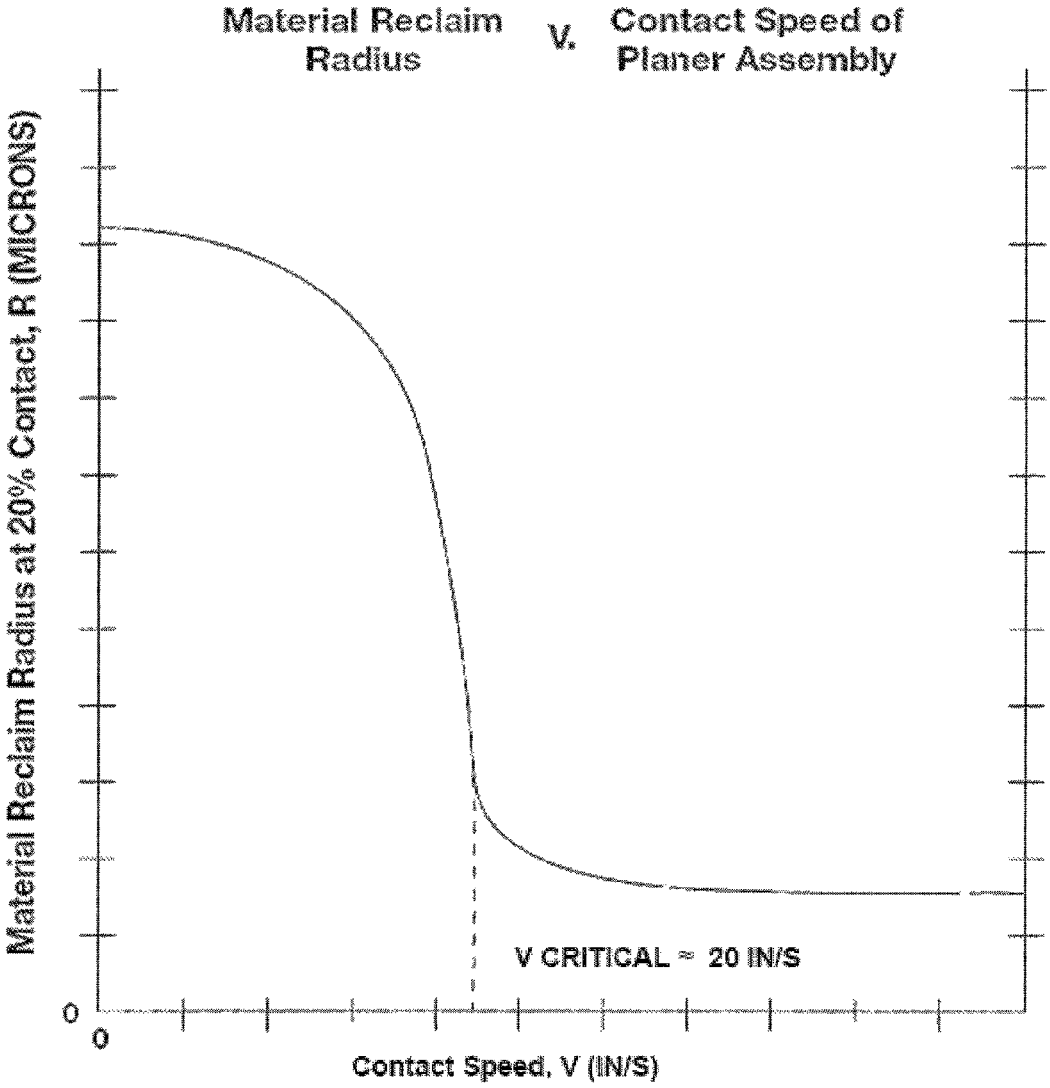
FIG. 4 is a graph showing the material reclaim radius versus contact speed of planer assembly, which is the size of the material that is planed off of the surface to be finished.

FIG. 4 is a graph showing the contact speed, or tangential velocity, of the planer assembly versus material reclaim radius. Tangential velocity (V)=radius·angular velocity. The material reclaim radius generally slowly decreases as the contact speed of the planer assembly with respect to the material increases until the contact speed approaches approximately 10 in/sec, at which point the material reclaim radius decreases rapidly. After the contact speed of the planer surpasses approximately 15 in/see, little further reduction in material reclaim radius occurs. Therefore, for the contact speed of the planer assembly greater than approximately 15 in/see, the scrubber is well suited for providing an even finish.

Figure 5:
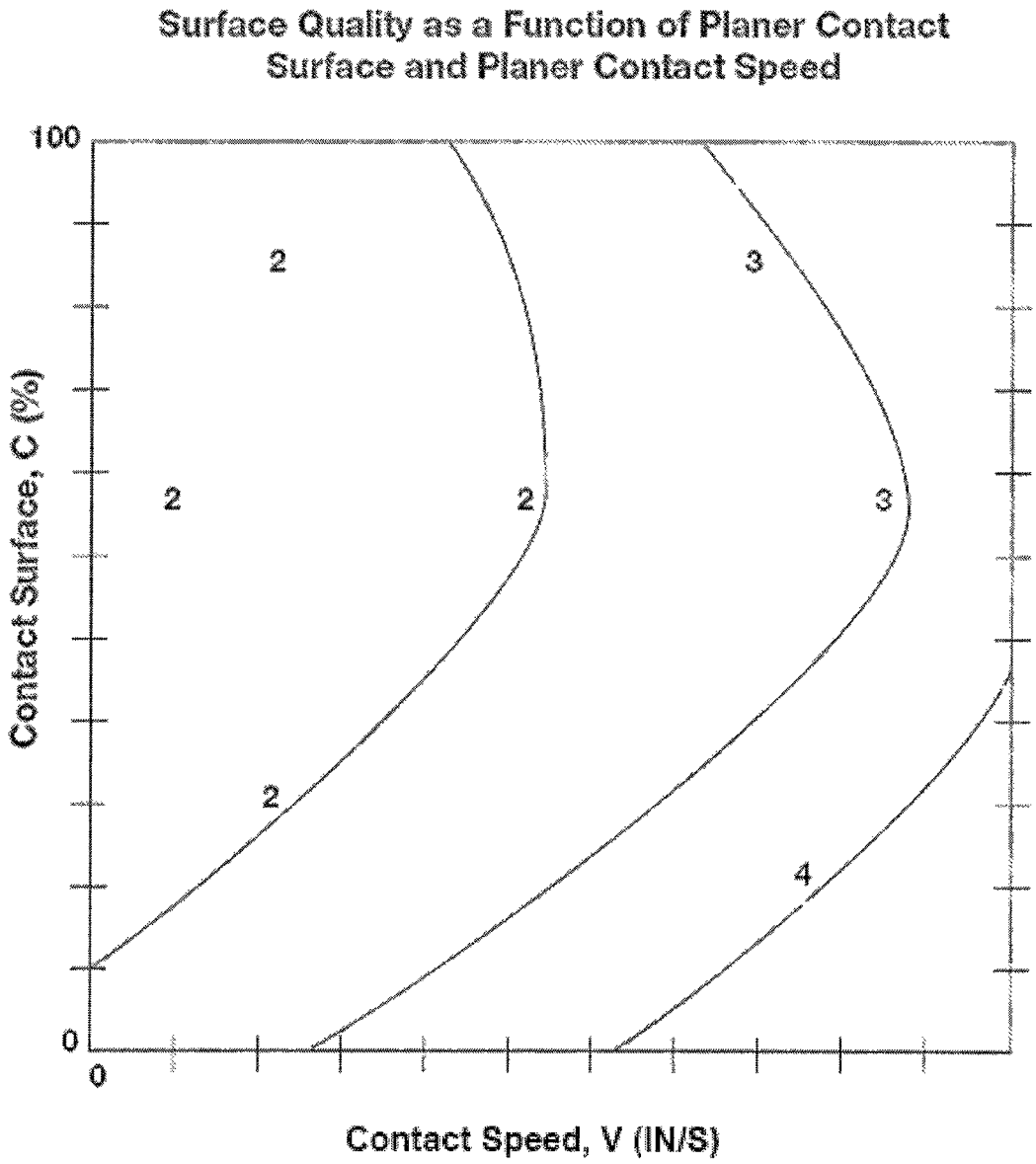
FIG. 5 is a graph showing the surface quality of the material to be finished as a function of the planer assembly's contact surface and contact speed.

FIG. 5 is a graph showing the surface quality of the material to be finished as a function of the planer assembly contact surface and contact speed. The numerals in the graph indicate the surface quality in relative terms, with higher numerals indicating more desirable surface quality at a corresponding planer contact surface level and planer contact speed. Therefore, it is apparent that to have a desirable high level of loading resistance, the amount of planer contact surface and the planer contact speed must be varied accordingly.

Figure 6:
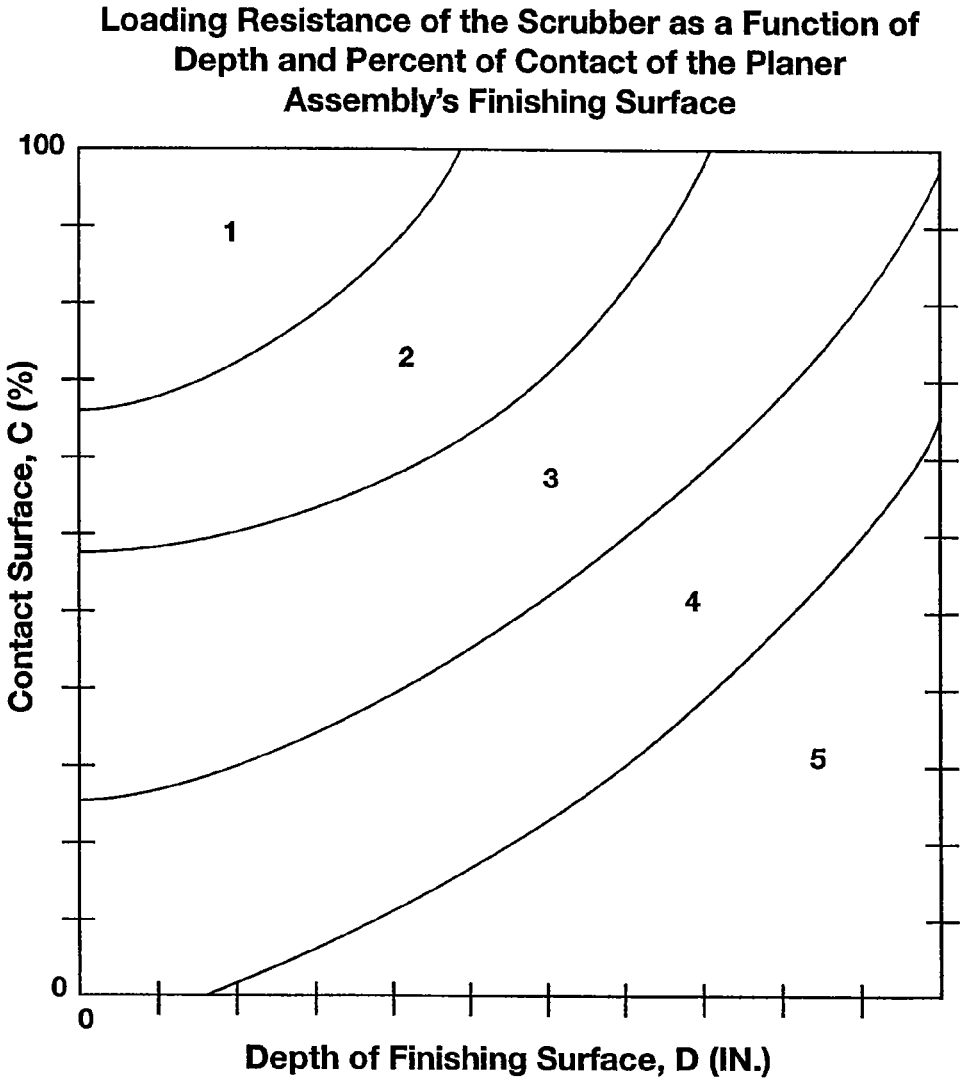
FIG. 6 is a graph showing the loading resistance of the scrubber as a function of the depth and percent contact of the planer assembly's finishing surface.

FIG. 6 is a graph that shows how the loading resistance of the scrubber varies as a function of depth and percent of contact of the planer assembly's finishing surface. The graph teaches that the contact surface and depth of the planer assembly's finishing surface must be varied together so as to produce a scrubber with adequate loading resistance. Different roller surfaces will have different loading characteristics. FIG. 6 is depicting only one set of relationships from one type of roller surface.

Certain modifications and improvements will occur to those skilled in the art upon a reading of the foregoing description. By way of example, safety, performance, and ergonomic improvements can be made to the apparatus. Using a handle as a positioner is one such example. In addition, ergonomic switches may be used with the apparatus. All other such modifications and improvements have been deleted herein for the sake of conciseness and readability but are properly within the scope of the following claims.

We claim:

1. A scrubber apparatus for finishing the face of a material having blown insulation applied as discrete elements having a material radius, the apparatus comprising:

(a) a vacuum conduit;

(b) a planer assembly attached to the vacuum conduit, wherein the planer assembly includes a brush roller having a contact surface and an axis of rotation, wherein the contact surface is configured to rotate around the axis of rotation at a speed with respect to the discrete insulation material of between about 10 in/sec and about 300 in/sec;

(c) a drive for the planer assembly;

(d) a vacuum adjacent to the planer assembly for removing loose discrete elements created during finishing; and (e) a supply of reclaimed discrete elements, wherein the radius of the reclaimed discrete elements is about 10 microns to about 10,000 microns, and wherein the reclaimed discrete elements are configured to be reinstalled as blown insulation.

2. The apparatus according to claim 1, further including a collector attached to the vacuum conduit adjacent to the planer assembly and the vacuum.

3. The apparatus according to claim 1, wherein the brush roller is selected from the group consisting of a coil brush roller and a chevron brush roller.

4. The apparatus according to claim 3, wherein the axis of rotation of the brush roller is substantially parallel to the face of the material.

5. The apparatus according to claim 1, wherein the contact surface rotates at a speed with respect to the material of about 40 in/sec.

6. The apparatus according to claim 1, wherein the supply of reclaimed discrete elements include cellulosic material having a radius of about 1,000 microns.

* * * * *